US006370349B2

(12) United States Patent
Tsuji et al.

(10) Patent No.: US 6,370,349 B2
(45) Date of Patent: Apr. 9, 2002

(54) TONER STORING CONTAINER AND TONER REPLENISHING DEVICE THEREWITH

(75) Inventors: Yasuaki Tsuji; Masahiro Yoshino; Tatsuo Nakanishi, all of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/749,229

(22) Filed: Dec. 27, 2000

(30) Foreign Application Priority Data

Jan. 17, 2000 (JP) ..... 2000-007675
Jan. 17, 2000 (JP) ..... 2000-007677

(51) Int. Cl.[7] ..... G03G 15/08

(52) U.S. Cl. ..... 399/262; 222/DIG. 1; 399/258

(58) Field of Search ..... 222/DIG. 1; 399/119, 399/120, 252, 258, 260, 262, 263

(56) References Cited

U.S. PATENT DOCUMENTS 5,966,574 A * 10/1999 Ui et al. ..... 399/258

* cited by examiner

*Primary Examiner*—Arthur T. Grimley
*Assistant Examiner*—Hoang Ngo
(74) *Attorney, Agent, or Firm*—Bierman, Muserlian and Lucas

(57) ABSTRACT

A cylindrical toner storing container that engages with a rotation transmitting member of a developing device provided in an image forming apparatus to rotate around the rotation axis integrally with the rotation transmitting member and thereby supplies or replenishes toner to the developing device. The toner storing container has a cylindrical base body that has a toner outlet opening in the vicinity of the rotation axis on one end, the cylindrical base body has on the inner surface thereof a protruded spiral ridge, and the number of the spiral ridge on a cross section of the cylindrical base body is increased as the cross section nears the toner outlet opening.

11 Claims, 7 Drawing Sheets

TONER STORING CONTAINER AND TONER REPLENISHING DEVICE THEREWITH

BACKGROUND OF THE INVENTION

The present invention relates to a toner storing container used in an image forming apparatus such as a copying machine and a printer, a toner replenishing device and toner for electrophotographic development filled in the toner storing container.

A toner storing container and a toner replenishing device used in an image forming apparatus such as an electrophotographic apparatus have been required to cope with high speeds and multiple types of the image forming apparatuses. Namely, the high speeds have required that a toner storing container has a larger capacity, and toner in the toner storing container can be supplied constantly to a developing device. When residual toner in the toner storing container is running low, in particular, it is required that toner remaining on the bottom of the toner storing container is supplied smoothly to the developing unit, and the toner storing container is replaced with new one. On the other hand, multiple types require that each type is made to be common, because a change in a shape of the toner storing container and a change in the toner replenishing device for each type cause a remarkable cost increase. However, if everything is made to be common completely, toner storing containers each containing toner of different color or different type are set erroneously, which is an evil. Therefore, there has been demanded a means to prevent erroneous setting of the toner storing container.

Further, in the past, as a material of a container which is filled with powder such as toner for electrophotographic development used for copies, there have been used metal, paper and plastics. Presently, with regard to a material for a main body of the container, a container which is made of plastic to be almost cylindrical in terms of a shape has become popular. The reason for this is that productivity in manufacturing is excellent, powder such as toner can be filled efficiently, an object filled inside such as toner for electrophotographic development is not adversely affected, and a shape of an engaging section that functions when the container is loaded in a developing unit is relatively easy for manufacture.

Objects filled in these containers are not allowed to leak out of the containers and to scatter in any case of their preservation, transport and installation in an image forming apparatus. Recently, these containers are in a tendency that they are collected and reused for the reasons of conservation of natural resources and prevention of environmental pollution.

However, when reusing the containers, they need to be Classified for separation into members that can be reused if they are just cleaned as they are and those that require to be molded again for reusing, by considering various factors such as a property and cost of a material, guarantee of reliability for reusing, and simplicity (no environmental pollution is emitted) for disposal.

Further, a method to use adhesive agents is not preferable, because manufacture of containers or disassemble and separation of containers for reusing must be easy. In addition, it is important that a member that can not be reused can easily be distinguished, because a big problems is caused if it is reused after being used once.

Presently, however, a container which satisfies all the requirements stated above and toner for electrophotographic development filled in the container have not been manufactured.

SUMMARY OF THE INVENTION

The first object of the invention is to provide, for high speeds of an image forming apparatus, a toner storing container and a toner replenishing device wherein toner in the toner storing container can be supplied constantly to a developing device even when residual toner is running low, and to provide, for multiple types of an image forming apparatus, a toner storing container and a toner replenishing device wherein a structure for preventing erroneous setting of the toner storing container is simple, the basic structures of the toner storing container and the toner replenishing device do not need to be changed, and many types of toner can be distinguished by a slight design change.

The second object of the invention is to provide a powder storing container in which powder such as toner for electrophotographic development is filled wherein filled objects neither leak out nor scatter in any case of their preservation, transport and installation in an image forming apparatus, adhesive agents are not used for assembling, cleaning of a member that can be reused after it is cleaned is easy, it is easy to separate a member that needs to be molded again for reusing from a member that is reused as it is, and a member once used can easily be distinguished, and to provide toner for electrophotographic development filled in the powder storing container.

The first object of the invention is attained by employing either one of the following structures.

Structure 1: A cylindrical toner storing container that engages with a rotation transmitting member of a developing device provided in an image forming apparatus to rotate around the rotation axis integrally with the rotation transmitting member and thereby supplies or replenishes toner to the developing device, wherein the toner storing container has a cylindrical base body that has a toner outlet opening in the vicinity of the rotation axis on one end, the cylindrical base body has on its inner surface a protruded spiral ridge, and the number of the spiral ridges on a cross section of the cylindrical base body is increased as the cross section nears the toner outlet opening.

Structure 2: The cylindrical toner storing container described in Structure 1 wherein the number of the spiral ridges on the cross section of the cylindrical base body stated above is two or more at the portion where the number of the spiral ridges is greatest, and a length of each of the two or more spiral ridges is not less than a length of the circumference of a circle of the cylindrical base body.

Structure 3: A cylindrical toner storing container that engages with a rotation transmitting member of a developing device provided in an image forming apparatus to rotate around the rotation axis integrally with the rotation transmitting member and thereby supplies or replenishes toner to the developing device, wherein the toner storing container has a cylindrical base body that has a toner outlet opening in the vicinity of the rotation axis on one end, the cylindrical base body has on its inner surface a protruded spiral ridge, and has on its outer surface two or more straight grooves in a direction of the rotation axis.

Structure 4: The cylindrical toner storing container described in Structure 3 wherein the number of the spiral ridges on a cross section of the cylindrical base body stated above is increased as the cross section nears the toner outlet opening.

Structure 5: The cylindrical toner storing container described in Structure 4 wherein the number of the spiral ridges on the cross section of the cylindrical base body stated above is two or more at the portion where the number of the spiral ridges is greatest, and a length of each of the two or more spiral ridges is not less than a length of the circumference of a circle of the cylindrical base body.

Structure 6: A toner replenishing device that makes one end of a cylindrical toner storing container having on its one end a toner outlet opening to engage with a rotation transmitting member of a developing device provided in an image forming apparatus to rotate the toner storing container around the rotation axis of the toner storing container integrally with the rotation transmitting member, and thereby makes toner in the toner storing container to be ejected out of the toner output opening to be replenished to the developing device, wherein the toner storing container has a cylindrical base body that has a toner outlet opening on its one end, the cylindrical base body has on its inner surface a protruded spiral ridge, and the number of the spiral ridges on a cross section of the cylindrical base body is increased as the cross section nears the toner outlet opening.

Structure 7: A toner replenishing device to eject toner in the toner storing container and thereby to replenish the toner in a developing device provided in an image forming apparatus having therein a rotation transmitting member and a toner storing container holding member, by inserting a cylindrical toner storing container having a toner outlet opening on its one end and thereby engaging the toner outlet opening with the rotation transmitting member to rotate the toner storing container around its rotation axis integrally with the rotation transmitting member, wherein the toner storing container has a cylindrical base body that has a toner outlet opening on its one end, the cylindrical base body has on its inner surface a protruded spiral ridge, and has on its outer surface two or more straight grooves in the direction of rotation axis and are formed at different positions depending on a color and a type of toner stored in the toner storing container, and there are formed protrusions corresponding to the straight grooves which guide only toner storing container having the straight grooves storing therein toner used in the developing device to the toner storing container holding member.

The toner storing container of Structure 1 has a cylindrical base body, and when the toner storing container rotates, a protruded spiral ridge on an inner circumferential surface of the cylindrical base body shows a function of a rib that conveys toner to a toner outlet opening, and thereby, toner in the toner storing container is stirred by rotation of the toner storing container and is conveyed simultaneously to the toner output opening.

Further, due to the number of the spiral ridges on the cross section of the cylindrical base body that is increased as the cross section nears the toner outlet opening, transportability for toner in the toner storing container is improved by the leaps and bounds, which makes it possible to supply toner smoothly to the developing device even when residual toner in the toner storing container is running low. In particular, when two or more spiral ridges are provided at the portion near the toner outlet opening where the number of spiral ridges on the cross section of the cylindrical base body is greatest, and each of the two or more spiral ridges has a length that is longer than that of the circumference of a circle, supply of toner from the toner storing container to the developing device is remarkably accelerated, and toner can be supplied smoothly to the developing device even when residual toner in the toner storing container is running low. It is preferable that the number of ridges is an even number, and two or four ridges are further preferable, and two ridges are especially preferable. It is preferable that a height of the protrusion forming a ridge is 1–30% of a diameter of the toner storing container at the position of the protrusion whose height is measured. It is preferable that a pitch of the spiral in the case of one ridge (a distance from the center on the summit of the ridge to the center on the summit of the protrusion of the neighboring ridge) is 5–100 mm, and a pitch which is a half the aforesaid figure may be employed in the case of two or more ridges.

The inventions in Structures 3, 4 and 5 represent an invention of a toner storing container wherein the toner storing container has its basic structure to have the spiral ridge, and when this basic structure is used for various types of toner storing containers, a simple identification mechanism is added without changing the basic structure for discriminating each toner. Namely, by forming, on the outer circumferential surface of the cylindrical toner storing container, straight grooves in the axial direction of the cylinder, in addition to the spiral ridge that accelerates the transportability for toner, it is possible to provide a toner storing container in which toner types can easily be identified by changing the position of the straight grooves on the outer circumferential surface of the toner storing container without changing the basic structure of the toner storing container.

Namely, when the toner storing container to be set in the toner replenishing device described in Structure 6 stores toner that is of the same type as that of toner used for a developing device to which toner is replenished from the toner replenishing device, straight grooves formed on the outer circumferential surface of the toner storing container engages with a protrusion formed on an inner surface of a toner storing container holding member, thus, toner in the toner storing container is supplied into the developing device. On the other hand, when the toner storing container to be set in the toner replenishing device does not store to be used for a developing device to which toner is replenished from the toner replenishing device, a straight groove formed on the outer circumferential surface of the toner storing container does not engage with a protrusion formed on an inner surface of the toner storing container holding member, thus, wrong setting of the toner storing container is avoided. Incidentally, though the cylindrical base body or the cylindrical form in the invention has basically a cylindrical shape, those wherein a diameter of a cylinder is different at the front portion and the rear portion of the cylinder are also included.

The second object of the invention is attained by employing either one of the following structures.

Structure 8: A toner storing container wherein a member having a toner outlet opening is press-fitted integrally on one end of a cylindrical base body, a cover member is press-fitted integrally on the other end of the cylindrical base body, and the press-fitted portion is of the following Compositions 1–3.

Composition 1: The cylindrical base body has, on each of opening sections (press-fitting portions) on its both ends, a protruded portion and a retracted portion both in a circular shape following a circle of the opening, Composition 2: each of a member having a toner outlet opening and a cover member has, in the press-fitting portion, a circular groove formed by an inner ring extending from a side wall and having elasticity and by the side wall, and has, in the circular groove, a protrusion protruded from the side wall, and an edge portion of the inner ring extended extremely from the side wall is positioned to be farther than the protrusion protruded from the side wall, and Composition 3: in the state where the base body is integrally press-fitted with the member having a toner outlet opening and with the cover member, at any section of the press-fitting portion, opening sections on both ends of the base body are respectively inserted in the circular grooves stated above, and two or more of three pairs including a pair of the inner ring and the protruded portion of the retracted/protruded portion of the base body, a pair of a slanting surface on the protrusion in the groove protruded from the side wall and an edge section of the retracted portion of the retracted/protruded portion of the base body and a pair of a root section of the inner ring and an edge portion of the base body, are kept to be in close contact and engagement.

Structure 9: The toner container for electrophotographic development wherein the toner storing container described in Structure 8 having a spiral form that is convex on an inner circumferential surface and is concave on an outer circumferential surface is employed, and the toner outlet opening is engaged with a rotation transmission member in the image forming apparatus to supply or replenish toner to a developing unit.

Structure 10: The toner container for electrophotographic development according to Structure 9 wherein the number of spiral forms of the toner container in the vicinity of the toner outlet opening is two or more and a length of each of them is not less than a length of the circumference of the outer circumferential surface of the container.

Structure 11: Toner for electrophotographic development filled in the toner container for electrophotographic development described in Structure 9.

Structure 12: The toner storing container wherein the cylindrical base body, the member having a toner outlet opening to be press-fitted and the cover member all described in Structure 8 are made of a polyolefin material.

DETAILED DESCRIPTION OF THE PREFERRED EMBODIMENT

Figure 1:
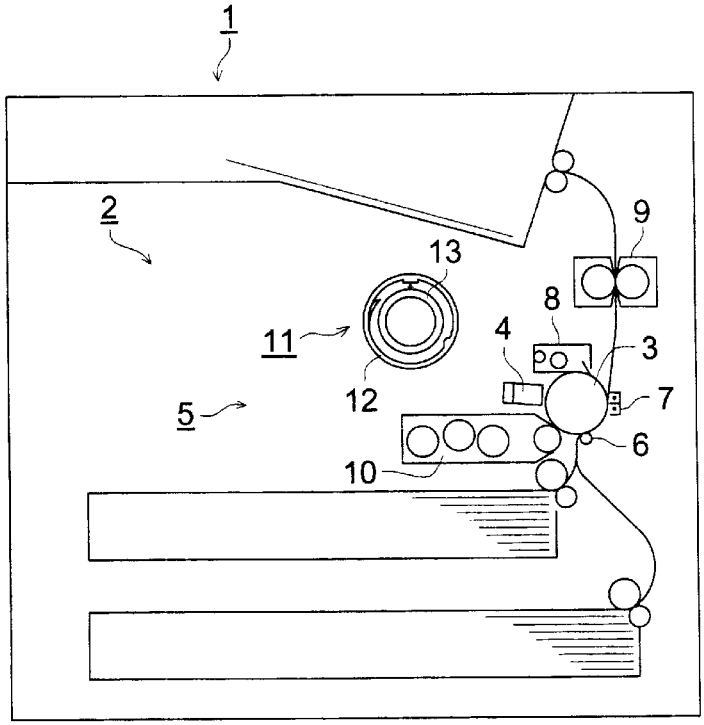
FIG. 1(*a*) is a longitudinal and sectional front view showing the simplified general structure of plain paper copying machine 1 representing an image forming apparatus, and FIG. 1(*b*) is a top view thereof.
Figure 1:
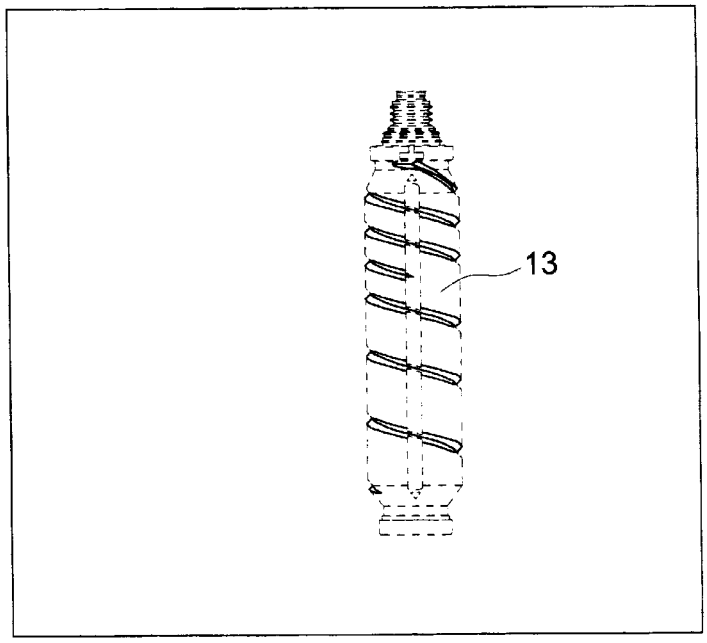

Structures 1–7 of the invention to attain the first object will be explained in examples as follows, referring to the drawings.

An example of the invention will be explained as follows, referring to FIG. 1(*a*)–FIG. 4. First, FIGS. 1(*a*) and 1(*b*) are respectively longitudinal and sectional front view 1(*a*) and top view 1(*b*) both showing the simplified general structure of ordinary sheet copying machine 1 representing an image forming apparatus, and drum-shaped photoreceptor 3 is provided at about central portion in main body case 2 of ordinary copying machine 1, charging/exposure device 4, developing device 5, transfer unit 6, separation unit 7 and cleaning device 8 are arranged around the photoreceptor 3, and fixing device 9 is arranged above the photoreceptor 3. The developing device 5 is composed of developing unit 10 and toner replenishing device 11.

Further, toner container holding member 12 is fixed on developing unit 10 on the toner replenishing device 11. The toner container holding member 12 is inserted so that cylindrical toner storing container 13 storing toner can rotate almost horizontally and freely. The drawings will be used as follows for explanation.

Figure 2:
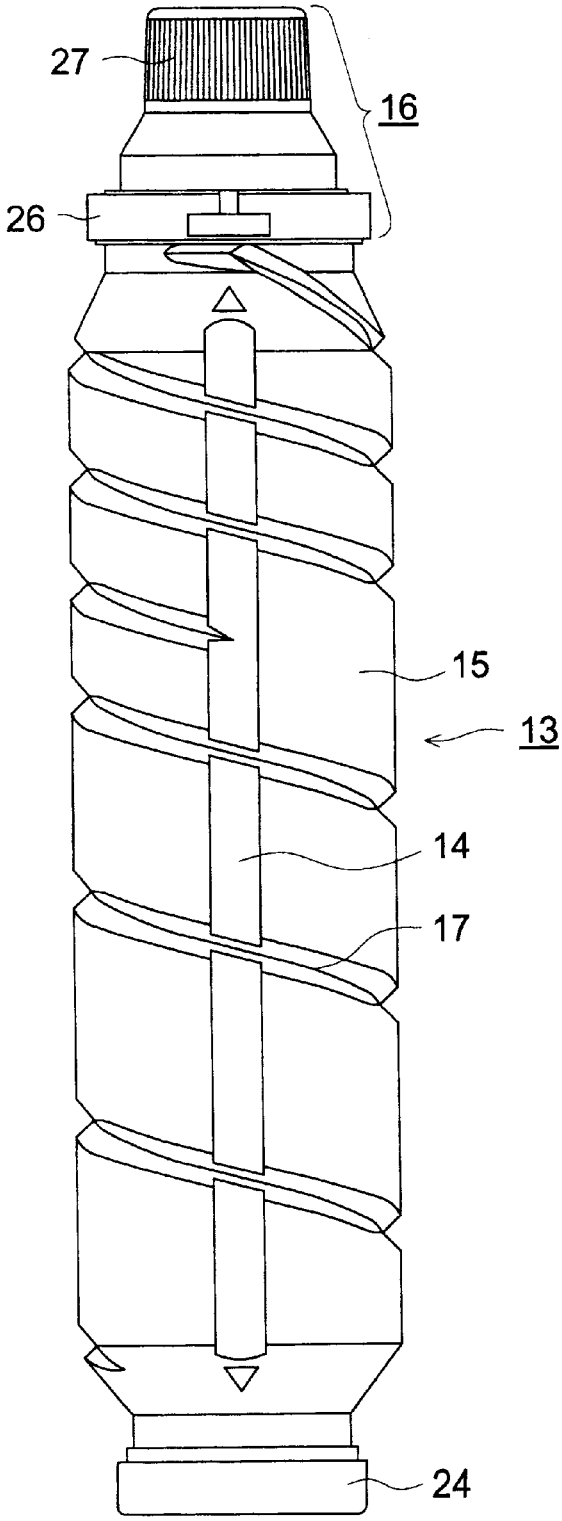
FIG. 2 is an appearance view of toner storing container 13.
Figure 2:
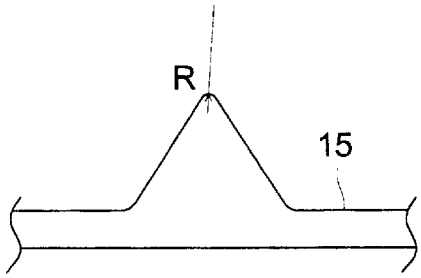
Figure 2:
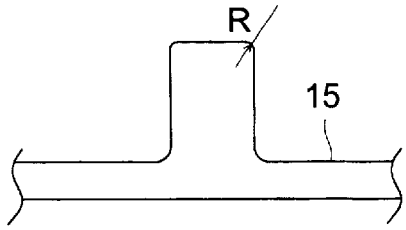
Figure 2:
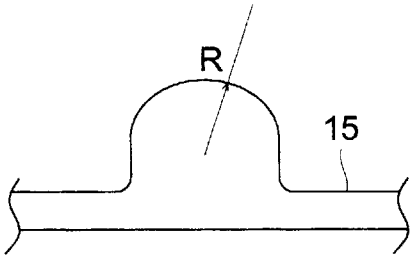
Figure 2:
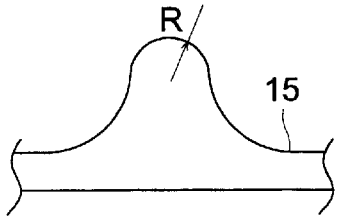

FIG. 2 is an appearance view of toner storing container 13.

Figure 3:
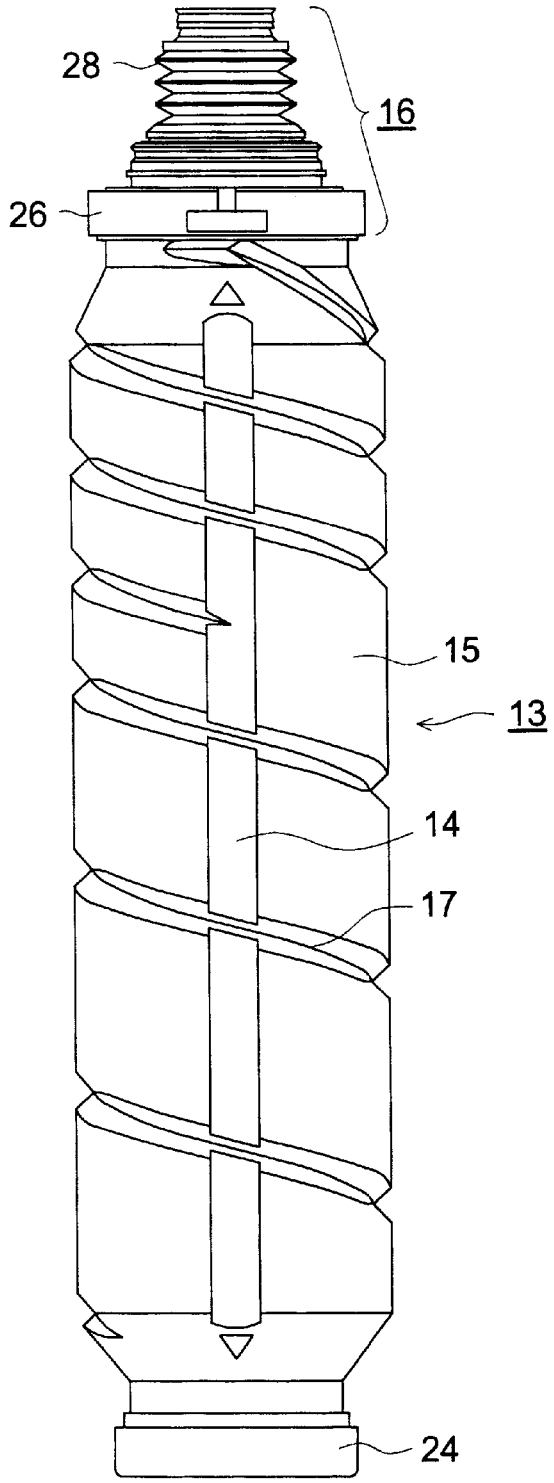
FIG. 3 shows a shape of the toner storing container 13 from which a cap of a toner replenishing inlet is removed.

FIG. 3 shows a shape of the toner storing container 13 from which a cap of a toner replenishing inlet is removed.

Figure 4:
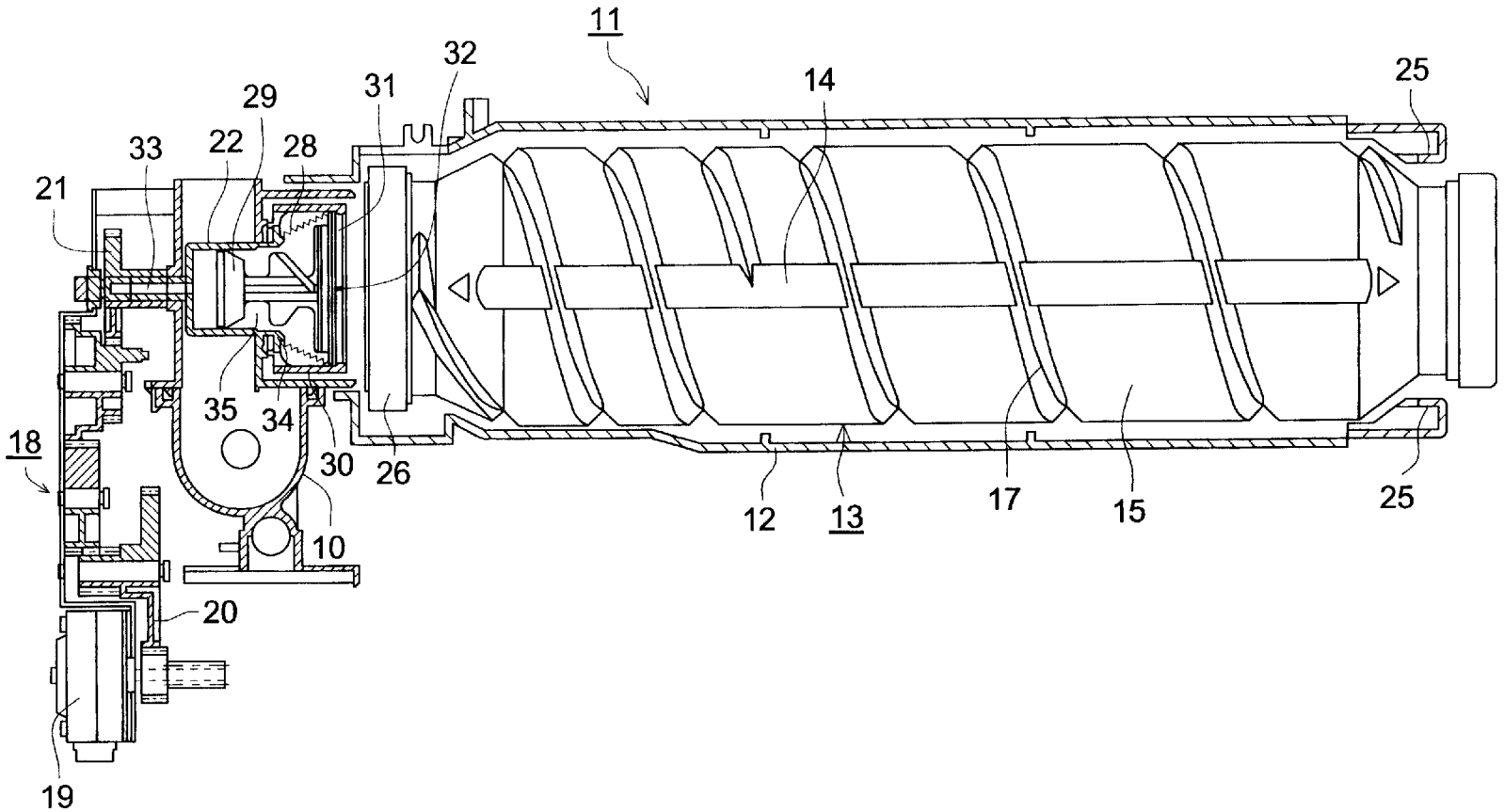
FIG. 4 is a sectional view of toner replenishing device 11.

FIG. 4 is a sectional view of toner replenishing device 11.

First, with regard to the toner storing container 13, toner replenishing inlet portion 16 is formed at the central portion on one end side of cylindrical container main body 15, the container main body 15 has spiral ridge 17 that is convex on the cylindrical inner circumferential surface and spiral groove 17 that is concave on an outer circumferential surface, and there is formed spiral ridge 17 wherein the number of the spiral ridges on a cross section of the cylindrical base body is increased as the cross section nears the toner outlet opening.

Namely, on the inner circumferential surface closest to the toner replenishing inlet portion, there is further formed one spiral ridge, and two ridges in total are formed. A spiral ridge whose length is not less than the circumference of the inner circumferential surface is formed on each of the two spiral ridges. When replenishing toner in the developing unit, the toner storing container 13 is rotated around the center axis of the cylinder by a rotation drive member, and when the toner storing container rotates, the spiral ridge serves as a rib that conveys toner toward toner outlet opening 35 positioned at the tip portion of the toner replenishing inlet portion. In that case, owing to that the number of spiral ridges on a cross section of a cylinder is increased as the cross section nears the toner replenishing inlet portion, the transportability for toner is improved greatly, and toner can be supplied to the developing device smoothly, even when residual toner in the toner storing container is running low. In particular, when two or more ridges on a cross section of a cylinder are provided at the place of the inner circumferential surface of toner storing container 13 that is close to the toner replenishing inlet portion, and when each of the two or more spiral ridges has a length that is not less than the circumference of the inner circumferential surface, supply of toner from the toner storing container to the developing device is accelerated greatly, and toner can be supplied to the developing device smoothly, even when residual toner in the toner storing container is running low. It is preferable that the toner storing container of the invention has a shape wherein a diameter of the container is gradually reduced as the position of the diameter nears the outlet opening in the axial direction of the storing container, in the vicinity of the outlet opening. It is preferable that an angle formed by an outer wall of the outer ring of the storing container and the direction perpendicular to the axial direction is within 45°.

Two straight grooves 14 which intersect with the spiral groove are provided on the outer circumferential surface of the toner storing container 13 in the direction of cylindrical axis as shown in FIG. 2 to cover the whole of the container main body of the toner storing container. Two protrusions 25 corresponding to the aforesaid two grooves are formed at an inlet section on the inner circumferential surface of the toner storing container holding member 12 into which the toner storing container is inserted.

When two straight grooves on the cylindrical toner storing container 13 agree in terms of position with two protrusions formed at an inlet section on the inner circumferential surface of the cylindrical toner storing container holding member 12 at positions on the joining circumference of a circle, it is possible to insert the cylindrical toner storing container 13 into the cylindrical toner storing container holding member 12 while positioning the two straight grooves to the two protrusions.

In this case, two straight grooves on the cylindrical toner storing container are different depending on a color and a type of toner stored in the toner storing container 13, and a position of a protrusion formed at an inlet portion of the inner circumferential surface of the cylindrical toner storing container holding member 12 is also different depending on a color and a type of toner used in the aforesaid developing device 5. Then, if the two straight grooves on the cylindrical toner storing container agree in terms of a position and a shape with two protrusions formed at the inlet portion of the inner circumferential surface of the cylindrical toner storing container holding member, only when the toner used in the developing device 5 agrees with the toner stored in the toner storing container 13, the toner storing container 13 can be inserted into the cylindrical toner storing container holding member 12 when the grooves are positioned at the positions of the protrusions.

On the other hand, when the toner used in the developing device 5 does not agree with the toner stored in the toner storing container 13, the aforesaid two straight grooves do not agree in terms of a position and a shape with the two protrusions 25, and the toner storing container is prevented from being inserted into the cylindrical toner storing container holding member, thus, erroneous setting of the toner storing container is prevented.

Toner replenishing device 11 of the invention is constituted as a part of the developing device 5, and is composed of the cylindrical toner storing container 13, the cylindrical toner storing container holding member 12 and rotation transmission member 18 which gives rotation to the cylindrical toner storing container. The rotation transmission member 18 is composed of motor 19, gear train 20 driven by the motor 19 to rotate, last gear 21 of the gear train 20 and junction holder 22 having rotary shaft 33 connected to the last gear 21. The toner storing container is inserted into the toner storing container holding member to be connected with the junction holder at replenishing inlet portion 16 of the toner storing container, and thereby, the toner storing container is rotated by the rotation of the junction holder. The rotation of the toner storing container is given when an amount or concentration of the toner in developing unit 10 become insufficient, and the toner in the toner storing container is supplied to the toner developing unit 10 from a toner outlet opening at the tip end of the toner storing container by the rotation of the toner storing container.

The replenishing inlet portion 16 of the toner storing container is composed of engaging cover 26 that engages with container main body 15 of the toner storing container at the tip portion of the container main body 15 of the toner storing container, cap 27, bellows inner cover 28 and toner outlet opening member 29. With regard to the engaging cover, an engaging groove for engaging with the front end of container main body 15 of t he toner storing container is formed on an inner circumferential surface of the engaging cover, and circular groove 31 for engaging with engaging claw 30 of the junction holder is formed on the outer circumferential surface of the engaging cover at the upper portion of the engaging groove, while on the circular groove, there are provided two engaging claw stoppers 32 for transmitting an operation of rotation of the engaging claw to the toner storing container for the positional relation of 180°.

The junction holder is composed of rotary shaft 33 connected with the last gear 21 and the bellows inner cover opening/closing claw 34, in addition to the engaging claw, and when toner outlet opening portion 29 representing a protruded end portion of the toner storing container is inserted into the junction holder, the bellows inner cover opening/closing claw 34 makes bellows inner cover 28 to slide toward the toner storing container main body side, thus, a bellows inner cover is moved to the position of opening, and toner outlet opening 35 is disclosed so that the toner storing container 13 is communicated with developing unit 10 through the toner outlet opening 35, and mounting of the toner storing container 13 is completed.

Therefore, when mounting the toner storing container 13 in the plain paper copying machine 1, if the cap 27 of toner storing container replenishing inlet portion 16 only is removed in advance, it is not necessary to open the bellows inner cover, and thereby, it is possible to prevent spewing out of toner from toner outlet opening 35 and to prevent that hands and cloths of a worker are contaminated by toner spewed out. Further, when taking out the toner storing container from the toner storing container holding member, the bellows inner cover returns to its original closed state. Therefore, the toner outlet opening 35 is covered by the bellows inner cover, and it is possible to prevent spewing out of toner stuck to protruded end portion of the toner storing container and to prevent that hands and cloths of a worker are contaminated by toner spewed out. The toner storing container of the invention can be manufactured by, for example, (1) blow molding (natural parison blow, injection blow), (2) injection molding, (3) extrusion molding and (4) paper sleeve+grooving by finishing processing, although there is no restriction for the manufacturing method.

In the invention described in Structures 1 and 2, the toner storing container has a cylindrical form having a toner outlet opening on its one end, the cylindrical form has a spiral ridge that is convex on the inner circumferential surface and the number of the spiral ridges on a cross section of the cylindrical form is increased as the cross section nears the toner outlet opening, as stated above. Therefore, it is possible to supply toner smoothly to a developing unit even when residual toner in the toner storing container is running low.

The invention described in Structures 3, 4 and 5 makes it possible to provide a toner storing container having the structure wherein the basic structure is a toner storing container having the spiral ridge, and when this basic structure is used for toner storing containers in various types, a simple distinguishing structure is added without changing the basic structure for distinguishing various toner types, and thereby, it is possible to supply toner smoothly to a developing unit even when residual toner in the toner storing container is running low, and to distinguish the toner storing container easily based on the toner type.

The invention described in Structure 6 makes it possible to provide a toner replenishing device that inserts a toner outlet opening portion of the cylindrical toner storing container into a rotation transmitting member provided in an image forming apparatus to rotate the rotation transmitting member around the center axis, and thereby makes toner in the toner storing container to be ejected out of the toner output opening to be replenished to the developing section, wherein the cylindrical form of the toner storing container has a spiral ridge that is convex on the inner circumferential surface and the number of the spiral ridges on a cross section of the cylindrical form is increased as the cross section nears the toner outlet opening, as stated above. Therefore, it is possible to supply toner smoothly to a developing unit even when residual toner in the toner storing container is running low.

The invention described in Structure 7 makes it possible to provide a toner replenishing device to replenish toner in the toner storing container to a developing section from the toner outlet opening by inserting a toner outlet portion of the cylindrical toner storing container into a rotation transmitting member provided in the image forming apparatus, and thereby, by making the toner storing container and the rotation transmitting member to rotate integrally around the center axis, wherein the toner storing container has a spiral ridge that is convex on the inner circumferential surface, and the number of spiral ridges on a cross section of the cylindrical form is increased as the cross section nears the toner outlet opening, and two or more straight grooves in the direction of cylindrical axis for the outer circumference of the outer circumferential surface and are formed at different positions depending on a color and a type of toner stored in the toner storing container are provided, and there are formed at the inlet portion of the toner storing container, the protrusions corresponding to the straight grooves which guide only toner storing container having the straight grooves storing therein toner used in the developing device to an inlet portion of the toner storing container holding member, thereby, when many types of toner storing containers are used, toner can be supplied smoothly in a developing unit and the toner storing container can be distinguished easily for a type of toner by adding a simple distinguishing mechanism without changing the aforesaid basic structure, even when an amount of residual toner in the toner storing container is running low.

Next, explanation will be given as follows, referring to a typical embodiment to attain the second object of the invention.

Figure 5:
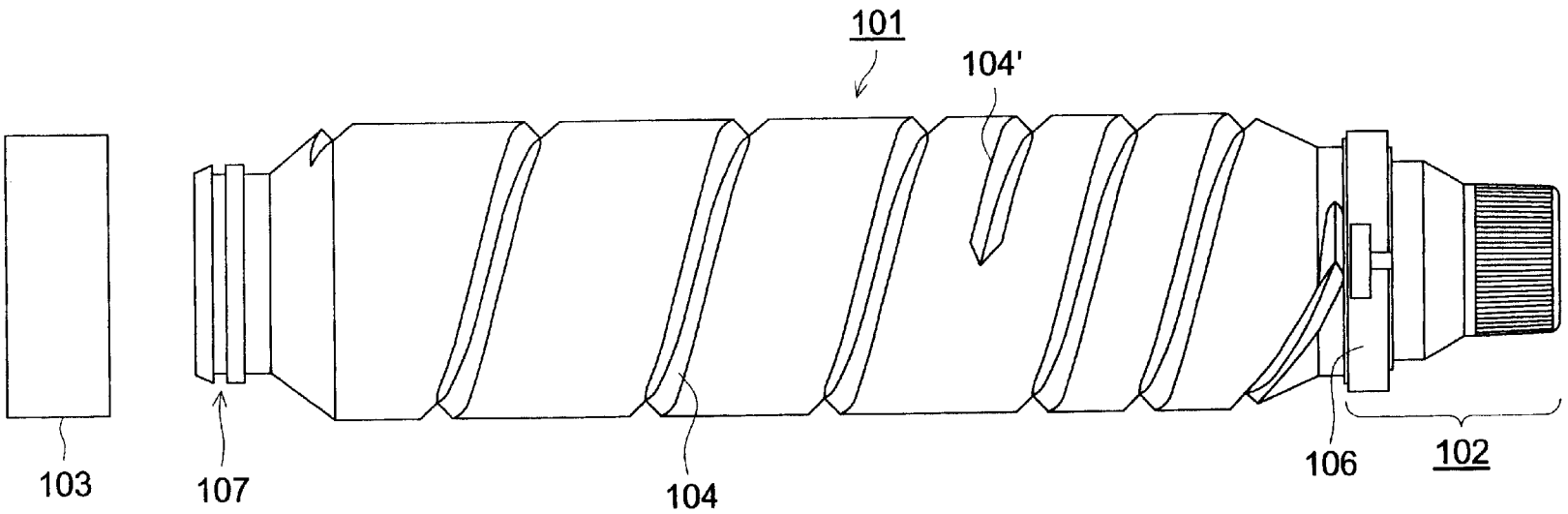
FIG. 5 is a perspective view showing an example of a toner container for electrophotographic development of the invention.

FIG. 5 is a perspective view showing an example of a toner container for electrophotographic development of the invention. The numeral 101 in the drawing represents a base body section, 102 represents a member having a toner outlet opening, 103 represents a cover member, and the base body section 101 has spiral form 104 that is convex on the inner circumferential surface and is concave on the outer circumferential surface. Incidentally, it is preferable that these spiral forms are provided to cover the cylindrical side entirely so that the toner transportability may be maintained when they are incorporated in the image forming apparatus to convey toner to a developing unit, and it is preferable that the number of the spiral forms on a cross section of the base body is two or more in the vicinity of the outlet opening (104' is present in addition to 104 in FIG. 5), and a length of the spiral form is not less than the circumference of the base body.

The cylindrical base body section 101 has, on each opening section (press-fitting portion) on its both ends, a concave-convex portion (a diameter of a concave-convex circular section following the circumference of the opening is usually 20–80 mm). Among the foregoing, the numeral 106 represents a portion which is press-fitted with a member having the toner outlet opening (its shape is not seen in FIG. 5, but is explained in FIG. 6), and the numeral 107 represents a portion which is press-fitted with a cover member. Since the shape of this portion and a method of press-fitting thereof are the same, explanation will be given as follows by using the portion 106 which is press-fitted with a member having the toner outlet opening.

A press-fitting and engaging method of the invention will be explained as follows, referring to FIG. 6. In the drawing, a base body section is represented by 101 and a member having a toner outlet opening is represented by 102, and the member 102 having the toner outlet opening has inner ring 112 which is extended, at the portion of press-fitting, from outer ring 111 and has elastic force and groove section 113 formed by the outer ring 111, and further has protrusion 114 that is protruded to the groove section from the outer ring, and tip portion 115 of the inner ring is arranged to be extended beyond the protrusion 114.

Figure 6:
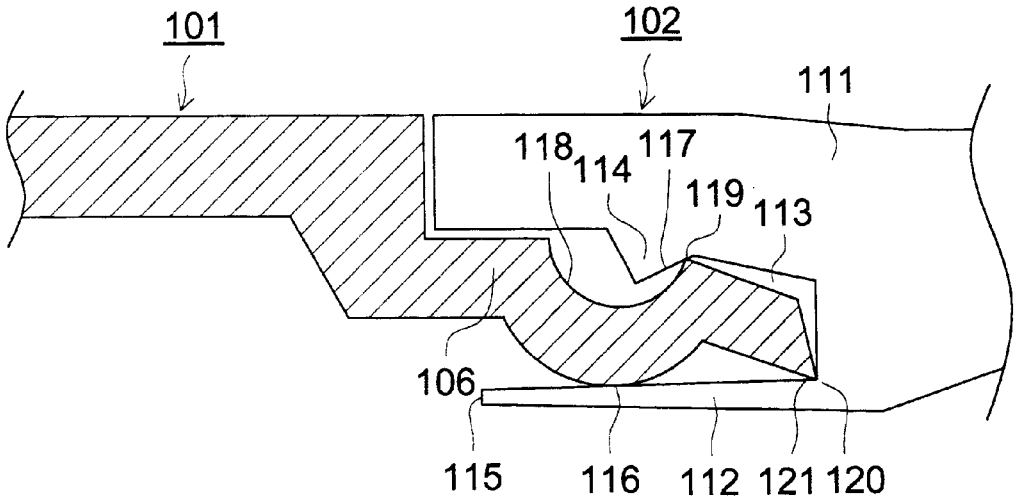
FIG. 6 is a sectional view showing the state wherein a base body and a member having a toner outlet opening are press-fitted integrally.

FIG. 6 is a sectional view showing how the base body section 1 is press-fitted integrally with the member 102 having the toner outlet opening, in which each opening section 106 on both ends of the base body section is inserted in the aforesaid groove section, and three locations of contact between the inner ring 112 and protruded portion 116 of the concave-convex portion of the base body section 101, between slanting surface 117 of the protrusion 114 in the groove section protruded from the outer ring 111 and edge portion 119 of concave portion 118 of the concave-convex portion on the base body section 101 and between root section 120 of the inner ring 112 and tip portion 121 of the base body section are kept to be in close contact. Due to these combined contacts, both members are firmly press-fitted to each other without depending on a force of adhesives. Incidentally, though the number of points of close contact in the explanation above is three because a sectional view of the toner container was used for the explanation, both members are naturally in close contact with each other on three circumferential lines, because the toner container is actually cylindrical. Incidentally, in the invention, close contact on at least two points are required and close contact on three points are preferable.

With regard to the press-fitting, it is apparent from FIG. 6 that it is possible to press-fit the base body section 101 easily in the groove section 113 formed by the inner ring 112 and by the outer ring 111, by positioning both members for the press-fitting and by applying a pressing force to a certain extent.

On the other hand, when separating both members by canceling the press-fitting, both members may be pulled by a force slightly greater than that for the press-fitting in the direction opposite to that for the press-fitting. A member press-fitted with the base body section is made, for example, of polyolefin and is originally deformed in the direction in which a diameter of the circle of outer ring 111 is expanded by the force that is generated in the press-fitting portion and is headed for the outside. Further, in the case of separation, when the edge portion 119 of the concave portion 118 of the concave-convex portion on the base body section 101 climbs over the tip of the protrusion 114 protruded from the outer ring 111, the outer ring 111 is forced to expand strongly by the edge portion 119, thus, the member is deformed in the direction in which a diameter of the circle is further increased. In this way, deformation in the state of press-fitting and deformation in the case of separation are combined, and when the member having a toner outlet opening (same for cover member) is used again as it is, an engagement circle to be formed by the slanting surface 117 and the edge portion 119 cannot be formed to lose the power to seal toner.

Therefore, even when a member having a toner outlet opening and a cover member are used by mistake without reforming, it is possible to notice the accidental use easily. Though a study was made in the past, seeking after a shape and a material which can stand against reusing, when plastic is used as a material, sufficient characteristics were not obtained by any methods, and it was difficult to notice the reused member, resulting in a problem that accident of toner leakage caused by reusing was caused frequently. It is possible to prevent the problem in the case of reusing without reforming, by utilizing the press-fitting mechanism of the invention and by deforming a part of the press-fitting portion positively in the case of disassembling a toner container.

On the other hand, a base body section of the toner container can be used again as it is, as far as its performance is concerned, but it needs to be cleaned before it is used again. If a member having a toner outlet opening press-fitted to the end of the base body section of the toner container of the invention and a cover member are removed from each of both ends of the base body section, the base body section of the toner container is of a cylinder shape, and cleaning of its inner surface is extremely easy.

As a material of which the toner container of the invention is made, resin of a polyolefin type, especially, polystyrene and polypropylene are preferable, because sealing force can be generated toward the center of a sealing circle by the deformation caused by press-fitting, in the case of these resins. Due to this, toner sealing of a non-gluing type is easy.

Further, toner filled in a toner container to be used in the invention may either be of a two-component type or be of a one-component type. Binder resin used for toner includes styrene-acrylic type binder resin, polyester type binder resin or polyolefin type binder resin, and any one of them can used. Further, additives including coloring agents are added to binder resins, and one used usually can be employed.

The present invention makes it possible to provide a toner storing container to store powder such as toner for electrophotographic development wherein filled object does not leak out scatter in any case of preservation, transportation and loading on an image forming apparatus, no adhesives are used for assembling, a member to be cleaned as it is for reusing can be cleaned easily, items which need to be formed again can easily be separated from a member to be reused as it is, and items used once can easily be distinguished, and to provide toner for electrophotographic development filled in the toner storing container.

What is claimed is:

1. A cylindrical toner storing container that engages with a rotation transmitting member of a developing device provided in an image forming apparatus to rotate around a rotation axis integrally with the rotation transmitting member, for replenishing toner to the developing device, the cylindrical toner storing containing comprising:

a cylindrical base body for storing toner therein, having a toner outlet opening at a central portion with respect to the rotation axis on one end thereof, having a shape in which a diameter of the cylindrical base body is gradually reduced as a position of the diameter approaches the toner outlet opening, and having a spiral ridge on an inner surface of the cylindrical base body, wherein a number of the spiral ridges on a cross section of the cylindrical base body is increased as the cross section approaches the toner outlet opening.

2. The cylindrical toner storing container of claim 1, wherein the number of the spiral ridges on the cross section of the cylindrical base body is two or more at a portion where the number of the spiral ridges is greatest, and a length of each of the two or more spiral ridges is not less than a length of a circumference of a circle of the cylindrical base body.

3. A cylindrical toner storing container that engages with a rotation transmitting member of a developing device provided in an image forming apparatus to rotate around a rotation axis integrally with the rotation transmitting member, for replenishing toner to the developing device, the cylindrical toner storing container comprising:

a cylindrical base body for storing toner therein, having a toner outlet opening at a central portion with respect to the rotation axis on one end thereof, having a shape in which a diameter of the cylindrical base body is gradually reduced as a position of the diameter approaches the toner outlet opening and having a spiral ridge on an inner surface of the cylindrical base body, wherein the cylindrical base body has two or more straight-line grooves that are formed on an outer circumferential surface thereof in a direction of the rotation axis, whereby a color and a type of toner stored in the toner storing container is distinguished from each other.

4. The cylindrical toner storing container of claim 3, wherein a number of the spiral ridges on a cross section is increased as the cross section approaches the toner outlet opening.

5. The cylindrical toner storing container of claim 4, wherein the number the spiral ridges on the cross section of the cylindrical base body is two or more at a portion where the number of the spiral ridges is greatest, and a length of each of the two or more spiral ridges is not less than a length of a circumference of a circle of the cylindrical base body.

6. A toner replenishing device for ejecting toner in a cylindrical toner storing container and for replenishing the toner to a developing device provided in an image forming apparatus having a rotation transmitting member and a toner storing container holding member, by inserting the cylindrical toner storing container having a toner outlet opening on one end thereof and thereby engaging the toner outlet opening with the rotation transmitting member to rotate the toner storing container around a rotation axis integrally with the rotation transmitting member, the toner replenishing device comprising:

the toner storing container having a cylindrical base body that has a toner outlet opening on one end of the cylindrical base body which has a protruded spiral ridge on an inner surface and has two or more straight-line grooves on an outer surface in a direction of a rotation axis that are formed at different positions depending on a color and a type of toner stored in the toner storing container, and there are formed protrusions corresponding to the straight-line grooves which guide only toner storing container having the straight-line grooves storing toner used in the developing device to the toner storing container holding member.

7. A cylindrical toner storing container that engages with a rotation transmitting member of a developing device provided in an image forming apparatus to rotate around a rotation axis integrally with the rotation transmitting member, for replenishing toner to the developing device, the cylindrical toner storing container comprising:

a cylindrical base body for storing toner therein, having a toner outlet opening in the vicinity of the rotation axis on one end thereof, and having a spiral ridge on an inner surface of the cylindrical base body, wherein a number of the spiral ridges on a cross section of the cylindrical base body is increased as the cross section approaches the toner outlet opening, a member including the toner outlet opening and having an engaging portion which is press-fitted integrally on one end of the cylindrical base body; and a cover member having an engaging portion, whose shape is the same as that of the member, which is press-fitted integrally on the other end of the cylindrical base body, wherein the cylindrical base body has, on each of circular press-fitting portions on both ends of the cylindrical base body, a protruded portion and a retracted portion both in a circular shape following a circle of the circular press-fitting portion, wherein each of the member having the toner outlet opening and the cover member has, in the engaging portion, a side wall, an inner ring having elasticity which extends from the side wall and a circular groove which is formed by the inner ring and the side wall, and has, in the circular groove, a protrusion protruded from the side wall, and an edge portion of the inner ring extended extremely from the side wall is positioned to be farther than the protrusion protruded from the side wall, and wherein when the cylindrical base body is integrally press-fitted with the member having the toner outlet opening and with the cover member, at any section of the circular press-fitting portion, opening sections on both ends of the base body are respectively inserted in the circular grooves, and two or more of three pairs including a pair of the inner ring and the protruded portion of the base body, a pair of a slanting surface on the protrusion in the groove protruded from the side wall and an outer edge section of a retracted portion of the base body, and a pair of a root section of the inner ring and an edge portion of the base body, are kept to be in close contact and engagement.

8. The cylindrical toner storing container of claim 7, wherein the cylindrical toner storing container is a toner container used for electrophotographic development.

9. The cylindrical toner storing container of claim 8, wherein the number of the spiral ridges of the cylindrical toner storing container in the vicinity of the toner replenishing opening portion is two or more, and a length of each of the two or more spiral ridges is not less than a length of a circumference of a circle of the cylindrical base body.

10. The cylindrical toner storing container of claim 8, wherein toner used for electrophotographic development is loaded in the toner storing container.

11. The cylindrical toner storing container of claim 7, wherein each of the cylindrical base body, the member having the toner outlet opening to be press-fitted and the cover member is made of a polyolefin material.

* * * * *